United States Patent [19]

Schetina et al.

[11] Patent Number: 4,998,777

[45] Date of Patent: Mar. 12, 1991

[54] COAL-CUTTING MACHINE HAVING HORIZONTALLY SWIVELLABLE JIB BOOM AND VERTICALLY SWIVELLABLE LOADING MEANS

[75] Inventors: Otto Schetina; Arnulf Kissich; Werner Stecher, all of Zeltweg; Helmut Habenicht, Weisskirchen; Wilhelm Papst, Lind bie Zeltweg; Bernhard Pleterski, Graz, all of Austria

[73] Assignee: Voest-Alpine Maschinenbau Gesellschaft m.b.H., Linz, Austria

[21] Appl. No.: 436,883

[22] Filed: Nov. 15, 1989

[30] Foreign Application Priority Data

Nov. 22, 1988 [AT] Austria ..... 2871/88

[51] Int. Cl.[5] ..... F21C 25/68; F21C 31/10

[52] U.S. Cl. ..... 299/67; 198/522; 299/73; 299/75

[58] Field of Search ..... 299/18, 64, 70, 73, 299/75, 76, 56, 67; 198/514, 515, 516, 522

[56] References Cited

U.S. PATENT DOCUMENTS

| | | | |
|---|---|---|---|
| 3,307,879 | 3/1967 | Bergmann | 299/75 X |
| 3,317,245 | 5/1967 | Arndt | 299/76 |
| 3,929,378 | 12/1975 | Frenyo et al. | 299/64 |
| 4,133,582 | 1/1979 | Kogelmann | 299/75 X |

FOREIGN PATENT DOCUMENTS

| | | | |
|---|---|---|---|
| 1284916 | 12/1968 | Fed. Rep. of Germany | 299/64 |
| 2592427 | 12/1985 | France . | |
| 647447 | 2/1979 | U.S.S.R. | 299/64 |

*Primary Examiner*—Ramon S. Britts
*Assistant Examiner*—David J. Bagnell
*Attorney, Agent, or Firm*—Cushman, Darby & Cushman

[57] ABSTRACT

A coal-cutting machine (1) having an all-round swivelling jib boom (6), on which cutting implements (17) are rotatably supported, and a loading platform (3) comprising a loading platform which can swivel about an axis (4) extending transversely to the longitudinal direction of the machine. The loading platform (3) is angularly, rigidly connected to the swing gear (5) for the swivelling of the jib boom (6) in a horizontal direction and is supported on the machine frame (1) so as to swivel, together with the swing gear (5), about the axis (4) extending transversely to the longitudinal direction of the machine. As a result of this construction which a particularly low overall height is made possible while safely preventing a collision between the jib boom (6) and the loading platform (3). A pivot axis (15) for the pivoting of the jib boom (6) in an essentially vertical direction, is preferably arranged between the swing gear (5), which is rigidly connected to the loading platform, and the rotatably supported cutting implements (17).

9 Claims, 1 Drawing Sheet

COAL-CUTTING MACHINE HAVING HORIZONTALLY SWIVELLABLE JIB BOOM AND VERTICALLY SWIVELLABLE LOADING MEANS

BACKGROUND OF THE INVENTION

1. Field of the Invention

The invention relates to a coal-cutting machine having an all-round swivelling jib boom, on which cutting implements are rotatably supported, and a loading means comprising a loading platform which can swivel about an axis extending transversely to the longitudinal direction of the machine.

2. Description of the Prior Art

In conventional coal-cutting machines of the kind mentioned at the outset, the loading platform can be swivelled independently of the pivoting position of the cutting arm or jib boom, the swivelling capacity of the loading platform being restricted to a swivelling of the loading platform about a substantially horizontal axis, and the cutting arm or jib boom being connected to a swing gear which permits a swivelling about an essentially horizontal axis and a pivoting about a substantially vertical axis. Swing gear of this kind must withstand the relatively large forces of reaction during hewing or cutting of rock and must therefore, as a rule, be of relatively large dimensions. In order to reduce the overall dimensions, in particular the height, of a coal-cutting machine, it has already been proposed in this context that the swing gear for the swivelling of the jib boom in the horizontal direction be designed to be separate from the swing gear for the pivoting of the cutting arm in the vertical direction. There is, however, particularly in the case of low-head machines, the danger of a collision between the loading platform and the cutting arm, when swivelling the loading platform with simultaneous pivoting of the cutting arm. A series of arrangements has, therefore, already been proposed, which arrangements are intended to define the swivelling angle of the loading platform and of the cutting arm relative to each other or, otherwise, to stop the swivel drives when an unsafe proximity is reached between loading platform and cutting arm.

SUMMARY OF THE INVENTION

The aim of the invention is now to provide a coal-cutting machine of the kind mentioned at the outset, which permits a particularly low overall height and in which a collision between the cutting arm or jib boom and the loading platform can be prevented reliably. To meet this object, the design according to the invention of the coal-cutting machine essentially resides in that the loading platform is angularly rigidly connected to the swing gear for the swivelling of the jib boom in the horizontal direction and is supported, together with this swing gear, on the machine frame to swivel about the axis which extends transversely to the longitudinal direction of the machine. As a result of the fact that the loading means is now fixedly and angularly rigidly connected to the swing gear for the horizontal swivelling of the jib boom, a uniform spacing is ensured in each swivelling position of the loading platform relative to the part of the cutting arm which, swivelling in a horizontal direction, engages directly on the swing gear. Even when the cutting arm swings in an upward direction as a result of an inclination of the swivel axis for swivelling in the horizontal direction together with a raising or lowering of the loading platform, this spacing is not affected, since the swivel plane of the jib boom, when swivelling about the axis of the swing gear in any such a swivelling position of the loading platform, remains in a predetermined geometric position relative to the plane of the loading platform.

In order to enlarge the range of application, in particular the region which can be swept in an upward direction by the coal-cutting machines, with, at the same time, as low a structural height of the machine as possible, the design can advantageously be such that the pivotal axis for the pivoting of the jib boom is arranged in an essentially vertical direction between the swing gear, which is rigidly connected to the loading platform, and the rotatably supported cutting implements. As a result of the fact that this second pivotal axis for the pivoting of the jib boom is arranged on the swivel arm in an essentially vertical direction spaced from the first swivel axis, the kinematics of pivoting can be designed in a simple manner such that, even in these cases, a collision with the loading platform is reliably prevented, despite the considerable pivoting capacity of the cutting arm, in connection with which, moreover, the advantage is achieved that, in all pivoting positions of the cutting arm in an upward direction, an essentially uniform, large cross-section is available for the conveying of the cut material. For this purpose, and in a particularly advantageous manner, the design is such that the pivotal axis for the pivoting of the jib boom is disposed in an essentially vertical direction in the projection in the direction of the gallery floor on the loading platform and, preferably, in the vicinity of the front edge of the loading platform. With a design of this kind, the pivoting capacity of the cutting arm can be increased without difficulty to such an extent that bottom cuts are possible, without this resulting in the danger of a collision with the loading platform.

In order to obtain a swing gear, which is as low as possible and accommodates high forces, for the swivelling of the cutting arm in the horizontal direction, the design can advantageously be such that the swivel drive for the swivel gear which is rigidly connected to the loading platform, is formed by cylinder-piston units which engage eccentrically relative to the swivel axis, for the swivelling of the jib boom in the horizontal direction, the free ends of which cylinder-piston units are supported on the loading platform, in particular in the vicinity of the loading platform. A drive means of this kind, for the swivelling of the cutting arm in the horizontal direction, can be designed to be very small in the upward direction, and very large forces can safely be accommodated, when the bearing plate is of a correspondingly dimensioned diameter, small drives therefore being sufficient.

In order to ensure a reliable supporting of the forces of reaction when swivelling the swing gear with the loading platform, the design is, advantageously, such that the drive means for the swivelling of the loading platform is supported behind the swivel axis on the machine frame, as a result of which the supporting forces can be absorbed, for example, in the vicinity of the centre of gravity of the coal-cutting machine.

BRIEF DESCRIPTION OF THE DRAWING

The invention will be described in more detail with reference to exemplified embodiments which are diagrammatically illustrated in the drawings wherein.

DETAILED DESCRIPTION OF THE PRESENTLY PREFERRED EXEMPLARY EMBODIMENT

Figures 1, 2:
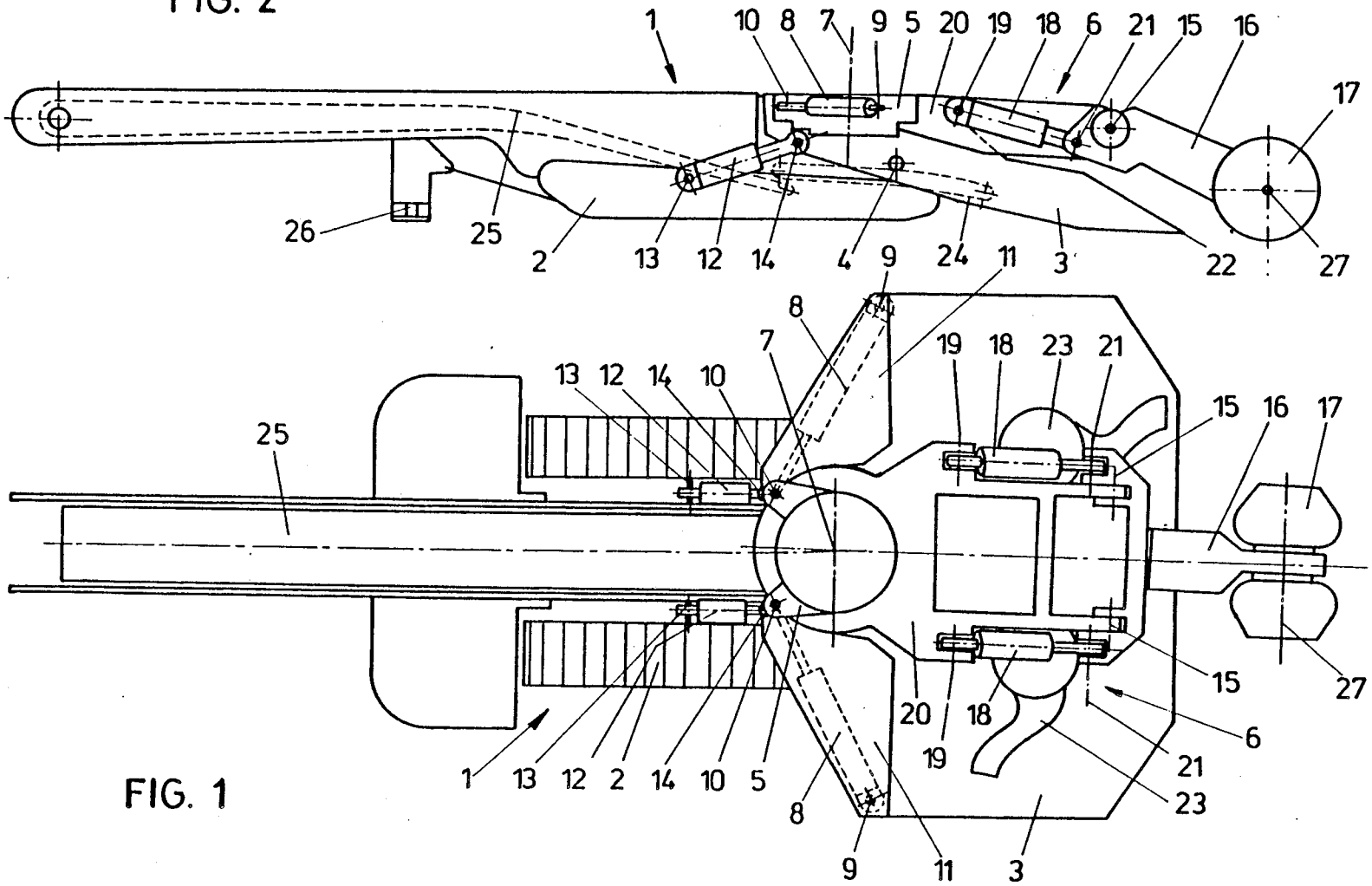
FIG. 1 shows a plan view of a coal-cutting machine.
FIG. 2 shows a side view of the coal-cutting machine illustrated in FIG. 1.

In FIGS. 1 and 2, reference numeral 1 designates a coal-cutting machine which is displaceable on track-laying gear 2. Hinged to the frame of the coal-cutting machine 1 is a loading platform 3 which can swivel about an axis 4 which extends transversely to the longitudinal direction of the machine. The loading platform 3 supports a swing gear 5 for the swivelling in a horizontal direction of a jib boom or cutting arm 6, the swing gear 5 being connected angularly rigidly to the loading platform 3. In this connection, the swivel axis of the cutting arm 6 is designated by reference numeral 7. To move the cutting arm 6 about the axis 7, as the swivel drive, cylinder/piston units 8 are provided which, on the one side, engage the loading platform 3 in the region of its lateral edge at reference numeral 9 and, on the other side, engage eccentrically at reference numeral 10 on the diagrammatically illustrated bearing plate of the swing gear 5. The cylinder/piston units 8 act as drive means for the swivelling of the cutting arm 6 in an essentially horizontal direction can, in this regard, be provided in a region which is protected by a covering 11.

Cylinder/piston units 12 are provided for the raising and lowering of the loading platform 3 about the axis 4. The cylinder/piston units 12 are hinged, on the one hand, to the frame at reference numeral 13, and which, on the other hand, engage the loading platform 3 at reference numeral 14, as can clearly be seen in FIG. 2. The cylinder/piston units 12 act as drive means for the swivelling of the loading platform 3 about the axis 4 and are, in this regard, supported on the machine frame 1 behind this swivel axis 4 of the loading platform 3, as a result of which the supporting forces can be accommodated in the region of the center of gravity of the machine. If the cylinder/piston units 12 are appropriately designed, the entire coal-cutting machine can, therefore, be supported in its region facing the working face, via the loading platform 3.

In addition to the swivelling capacity of the cutting arm 6 about the axis 7 in an essentially horizontal direction, via the swing gear 5, in order to increase the region which can be cut, in particular to increase the accessible height, the cutting arm 6 is designed to be divided and to pivot in an essentially vertical direction about an axis 15 which extends transversely to the longitudinal direction of the cutting arm 6. The front portion 16 of the cutting arm, to this end, supports rotatably supported cutting implements 17 which are formed, for example, by cutting heads, which rotate about the diagrammatically illustrated axis 27. For the pivoting of the front portion 16 of the cutting arm, as the pivot drives, cylinder/piston units 18 are provided, which engage, at reference numeral 19, with that portion 20 of the cutting arm 6 which is connected to the swing gear 5 and, at reference numeral 21, with the section 16 which supports the cutting implements. The pivot axis 15 for the additional pivoting in an essentially vertical direction of part of the jib boom or cutting arm 6 is provided, in the embodiment illustrated, in the region of the center of the length of the cutting arm, the projection of the pivot axis 15 in the direction of the gallery floor being disposed on the loading platform in the region of its front edge 22. As a result of such an arrangement of the pivot axis 15 for the pivoting of a part of the cutting arm in an essentially vertical direction, it is possible to design the entire coal-cutting machine to have a very low height, as can clearly be seen in FIG. 2, and to prevent, reliably, a collision between the cutting arm 6 and the loading platform 3.

Raising and lowering of the cutting arm 6, in any event, is carried out in each case together with a swivelling of the loading platform 3 about the axis 4 via the swing gear 5 for the swivelling of the jib boom 6 in a horizontal direction, said swing gear 5 being rigidly connected to the loading platform 3.

For the evacuation of the loading platform, known evacuating devices 23 are provided which are arranged to be rotatable and which sweep the surface of the loading platform 3. The quarried or cut material is transferred by the evacuating devices 23 on to a first conveyor 24 which is arranged in the loading platform 3, a transfer to a further conveyor 25, which is hinged to the machine frame, taking place in the region of the rear end of the loading platform 3. In this regard, this further conveyor can, in a manner known for accommodating downstream conveying means, be provided to be raised and lowered and/or also with a joint for a swivelling movement relative to the longitudinal direction of the machine, the drive means and swing gears or swivel axes for such an adjustment of the second conveyor 25 not being illustrated for the sake of greater clarity.

In addition to a support, which is made possible by the loading platform 3, in that region of the coal-cutting machine which faces the working face, a support means 26 can also be provided during operations in the end region of the coal-cutting machine which faces away from the working face, as can clearly be seen in FIG. 2.

As a result of the fixed or angularly rigid connection of the swing gear 5 to the loading platform 3, it is possible to obtain a very low overall height, the danger of a collision between the loading platform 3 and the cutting arm 6 is prevented by the relative position which is predetermined in each case, and it is highly practicable under crested or troughed conditions, as a result of the rigid frame construction of the coal-cutting machine 1, which is shortened in the direction of advancing in comparison to known constructions, since the entire region which faces the working face and which is formed by the loading platform 3 together with the swing gear 5 for the cutting arm or jib boom 6, can be raised and lowered via the cylinder/piston units 12 about the swivel axis 4 which extends transversely to the longitudinal direction of the machine.

We claim:

1. A coal-cutting machine including a swivelling jib boom on which cutting implements are rotatably supported and a loading means comprising a loading platform which can swivel about a first swivel axis extending transversely to a longitudinal direction of the machine, wherein the loading platform is angularly, rigidly connected to a swing gear that allows swivelling of the jib boom in a horizontal direction, and said loading platform is supported, together with said swing gear, on a frame of said coal-cutting machine so as to swivel about the axis extending transversely to the longitudinal direction of the machine, and wherein a swivel drive of the swing gear is formed by cylinder/piston units, each cylinder/piston unit having an end that engages eccentrically relative to a second swivel axis and a second end which is supported on the loading platform near lateral edges thereof.

2. A coal-cutting machine according to claim 1, wherein a pivot axis for the pivoting of the jib boom in an essentially vertical direction is disposed between the swing gear, which is rigidly connected to the loading platform, and the rotatably supported cutting implements.

3. A coal-cutting machine according to claim 2, wherein the pivot axis for the pivoting of the jib boom in an essentially vertical direction is disposed in a projection towards a gallery floor on the loading platform and proximate a front edge of the loading platform.

4. A coal-cutting machine according to any one of claims 1 to 3, wherein drive means for swivelling of the loading platform is supported on the frame of said coal-cutting machine behind the first swivel axis.

5. A coal-cutting machine including a swivelling jib boom on which cutting implements are rotatably supported and a loading means comprising a loading platform, said loading means being swivellable about only a first swivel axis extending transversely to a longitudinal direction of the machine, wherein the loading platform is angularly, rigidly connected to a swing gear that allows swivelling of the jib boom in a horizontal direction, and said loading platform is supported, together with said swing gear, on a frame of said coal-cutting machine so as to swivel about the axis extending transversely to the longitudinal direction of the machine, and wherein the jib boom is supported via said swing gear only by a loading ramp, being connected with said loading platform, and does not contact said frame.

6. A coal-cutting machine according to claim 5, wherein a pivot axis for the pivoting of the jib boom in an essentially vertical direction is disposed between the swing gear, which is rigidly connected to the loading platform, and the rotatably supported cutting implements.

7. A coal-cutting machine according to claim 6, wherein the pivot axis for the pivoting of the jib boom in an essentially vertical direction is disposed in a projection towards a gallery floor on the loading platform and proximate a front edge of the loading platform.

8. A coal-cutting machine according to any one of claims 5 to 7, wherein drive means for swivelling of the loading platform is supported on the frame of said coal-cutting machine behind the first swivel axis.

9. A coal-cutting machine according to any one of claims 5 to 7, wherein a swivel drive of the swing gear is formed by cylinder/piston units, each cylinder/piston unit having an end that engages eccentrically relative to a second swivel axis and a second end which is supported on the loading platform near lateral edges thereof.

* * * * *